US008494201B2

(12) United States Patent
Anderson

(10) Patent No.: US 8,494,201 B2
(45) Date of Patent: Jul. 23, 2013

(54) HEARING AID WITH OCCLUSION SUPPRESSION

(75) Inventor: James Robert Anderson, Chicago, IL (US)

(73) Assignee: GN ReSound A/S, Ballerup (DK)

( * ) Notice: Subject to any disclaimer, the term of this patent is extended or adjusted under 35 U.S.C. 154(b) by 175 days.

(21) Appl. No.: 13/022,428

(22) Filed: Feb. 7, 2011

(65) Prior Publication Data

US 2012/0070024 A1 Mar. 22, 2012

(30) Foreign Application Priority Data

Sep. 22, 2010 (EP) ..... 10178256

(51) Int. Cl.
*H04R 25/00* (2006.01)

(52) U.S. Cl.
USPC ..... 381/328; 381/312; 381/318

(58) Field of Classification Search
USPC ..... 381/312–313, 316–318, 320–321, 381/322, 328
See application file for complete search history.

(56) References Cited

U.S. PATENT DOCUMENTS

| | | | | |
|---|---|---|---|---|
| 4,985,925 | A | 1/1991 | Langberg et al. | |
| 6,937,738 | B2 | 8/2005 | Armstrong et al. | |
| 8,116,489 | B2 * | 2/2012 | Mejia et al. | 381/318 |
| 2003/0012391 | A1 | 1/2003 | Armstrong et al. | |
| 2003/0053647 | A1 | 3/2003 | Kates | |
| 2008/0063228 | A1 | 3/2008 | Mejia et al. | |
| 2009/0310805 | A1 | 12/2009 | Petroff | |
| 2010/0220881 | A1 | 9/2010 | Arndt | |

FOREIGN PATENT DOCUMENTS

| | | |
|---|---|---|
| EP | 1129600 | 9/1998 |
| EP | 2309778 | 4/2011 |
| WO | 0028784 | 5/2000 |
| WO | 2004021740 | 3/2004 |
| WO | 2006037156 | 4/2006 |
| WO | 2008043792 | 4/2008 |
| WO | 2008043793 | 4/2008 |

OTHER PUBLICATIONS

Mejia et al.: "Active Cancellation of Occlusion: An Electronic Vent for Hearing Aids and Hearing Protectors". Journal of the Acoustical Society of American Published for the Acoustical Society of America Through The American Institute of Physics USA, vol. 124, No. 1, Jul. 2008, pp. 235-240.

European Search Report mailed Dec. 1, 2010 for EP Application No. 10178256.3.

(Continued)

*Primary Examiner* — Suhan Ni
(74) *Attorney, Agent, or Firm* — Vista IP Law Group, LLP

(57) ABSTRACT

A hearing aid includes an ambient microphone configured to receive and convert environmental sound into an electronic input signal, a hearing loss processor configured to process the electronic input signal in accordance with a hearing loss of a user, and generate an electronic output signal, a receiver, an ear canal microphone configured for converting ear canal sound pressure into an ear canal signal, an occlusion suppressor for reception and processing of the ear canal signal and for transmitting an occlusion suppression signal, and a signal combiner configured for combining the occlusion suppression signal and the electronic output signal to form a combined signal, and for transmitting the combined signal to the receiver, wherein the receiver is configured to receive the combined signal, and convert the combined signal into an acoustic output signal, and wherein the receiver has a frequency response with a lower cut-off frequency that is less than 40 Hz.

21 Claims, 8 Drawing Sheets

OTHER PUBLICATIONS

Novelty Search Report dated Apr. 28, 2009 from Swedish Patent and Registration Office.

Jorge Mejia et al., "The Occlusion Effect and Its Reduction", 1st International Symposium on Auditory and Audiological Research, 2007, pp. 459-470, Australia.

European Search Report mailed Dec. 12, 2011 for EP Application No. 11182286.2.

Non-final Office Action dated Mar. 21, 2013, for U.S. Appl. No. 13/241,035.

* cited by examiner

HEARING AID WITH OCCLUSION SUPPRESSION

PRIORITY DATA

This application claims priority to and the benefit of European patent application No. EP 10178256.3, filed on Sep. 22, 2010, the entire disclosure of which is expressly incorporated by reference herein.

FIELD

The present application relates to a hearing aid which comprises an occlusion suppression system and a receiver with extended low frequency response to improve suppression of occlusion signals in a hearing aid user's ear canal.

BACKGROUND

The primary objective of a hearing aid is to compensate for a user's hearing loss by amplifying and otherwise processing environment al sound received at an outwardly placed or ambient microphone of the hearing aid. Amplified or processed sound is emitted to the user's fully or partially occluded ear canal through a suitable miniature loudspeaker or receiver in manner where at least partial compensation of the user's specific hearing loss is accomplished.

However, mounting an ear mould or housing of the hearing aid in the user's ear canal introduces new imperfections. One such imperfection is occlusion, which is a phenomenon caused by full or partial physical blocking of the user's ear canal. The hearing aid user experiences occlusion as an unnatural exaggerated perception of low frequency components of his/hers own voice as well as excessive perception of jaw and mouth sounds which are conducted directly through bone and tissue of the user. Occlusion perception generally increases the more the hearing aid housing or ear mould blocks the ear canal and may vary between different styles of hearing aids such as in-the-ear (ITE), completely-in-the-canal (CIC) and behind the ear (BTE) and different characteristics of an ear mould.

The effect of occlusion and occlusion suppression on a hearing aid user is explained shortly below in a simplified situation in which the only sound sources considered are the receiver and the body conducted sound. In this simplified case of sound emission from a hearing aid, sound heard by the user will be a combination of a perceived or excess body conducted sound ($B_P$=B−B'), and a receiver emitted sound (R), whereas a microphone in the ear canal would observe E=R+B=R+B'+$B_P$, i.e. including the unnoticed or reference sound B'.

To give a hearing aid user an experience of unoccluded hearing, a ratio between body conducted sound and receiver generated or emitted sound must correspond to the ratio between body conducted sound and ear canal conducted sound for an unoccluded ear. If it was possible to isolate the perceived body conducted sound ($B_P$), this sound could be emitted in opposite phase in the user's ear canal, with the effect of a perfect cancellation of the excess part of body conducted sound. This results in a perfect cancellation of occlusion sensation. However, in practice it is not possible to isolate the body conducted sound, and even less the perceived (i.e. "excess") body conducted sound, but an ear canal microphone may be used to register the combination of body conducted sound and receiver emitted sound (E=R+B).

Assuming two receivers were placed in the hearing aid user's ear canal, one receiver could emit the ambient sound with an appropriate gain g ($R_1$=g*A), and the other could subtract (i.e. emit in opposing phase) the registered ear canal sound with an appropriate gain f ($R_2$=f*E=f*($R_1$+$R_2$+B)=f*(g*A+$R_2$+B) or $R_2$=f(g*A+B)/(1−f)), resulting in a perceived ear sound:

$$(E=R_1+B'+B_P-R_2)=g*A+B-f(g*A+B)/(1-f)=(1-(f/(1-f))*(g*A)+B)).$$

The occlusion suppression task then becomes to balance f and g, such that the sound heard by the user has the same ratio of body conducted sound to receiver emitted sound as the ratio between body conducted sound and ear canal conducted sound for an unoccluded ear. While this suppression task may appear simple, in practice it will involve a rather complex and calculation intensive optimization, which may not be desirable to perform in practice with current calculation power of Digital Signal Processors for hearing aids, especially considering the simplifications in the above explanation.

The practical implementation of an occlusion suppressor will typically not involve the use of two receivers, but rather be implemented in a device configured for subtraction of an electrical signal prior to output amplification.

The latter implementation will require an occlusion suppressor configured for processing the ear canal sound or sound pressure such that the after amplification the sum of the signal from a hearing loss compensation means and the occlusion suppressor will suppress the perceived body conducted sound, such that when the hearing aid is in normal operation, the user will perceive only the hearing loss compensated signal, without a perceived body conducted sound.

Hearing aid occlusion may be combated or suppressed by two methods; venting, and more recently, by signal processing. Venting may be implemented either as an acoustical vent comprising acoustical channels or conduits extending through the hearing aid housing or extending through the ear mould. Venting may alternatively be implemented as a so-called "open fitting" hearing aid with a loose fit in the user's ear. Both methods can be effective in reducing the user's perception of occlusion by allowing low frequency sound in the ear canal to escape to the surrounding environment through the vent. Venting is, however, accompanied by two significant adverse effects:

1) A suppression or attenuation of low frequency sound generated by the hearing aid;
2) An increased risk of acoustical feedback and hearing aid instability because of acoustical leakage through the vent to an ambient microphone(s) of the hearing aid.

With respect to effect 1), low frequency components of the receiver sound is reduced by the same amount as the reduction in the occlusion level causing a reduction of both available low frequency gain and maximum undistorted output from the hearing aid at low frequencies. Since the individuals most affected by occlusion have mild loss to normal hearing at low frequencies, and thus don't need much, if any, gain for low frequencies, this is not necessarily a problem in itself.

With respect to effect 2), venting often leads to a requirement for feedback cancellation or suppression system to obtain a prescribed or target hearing aid gain. Feedback cancellation systems are accompanied by their own range of limitations and problems. Also, venting can give unpredictable results, sometimes producing much less occlusion reduction than expected. In some cases, venting may be supplemented by signal processing in suppression of occlusion in hearing aids.

Common for these approaches is that, an "ambient sound" received at the ambient microphone, is processed by a hearing loss processor to compensate for the hearing loss of a user to generate a desired sound, is combined with an compensation signal captured by a microphone in the user's partly or fully occluded ear canal volume in such a way that the sum of these signals suppresses the perceived excess body conducted sound.

While these approaches may be improvements over the previous approaches, Applicant of the subject application determines that they suffer from drawbacks, such as artefact sounds due to an unstable feedback loop or overload of an output amplifier or receiver enclosed in the feedback loop.

SUMMARY

In accordance with some embodiments, a hearing aid includes an ambient microphone configured to receive and convert environmental sound into an electronic input signal, a hearing loss processor configured to process the electronic input signal in accordance with a hearing loss of a user, and generate an electronic output signal, a receiver, an ear canal microphone configured for converting ear canal sound pressure into an ear canal signal, an occlusion suppressor for reception and processing of the ear canal signal and for transmitting an occlusion suppression signal, and a signal combiner configured for combining the occlusion suppression signal and the electronic output signal to form a combined signal, and for transmitting the combined signal to the receiver, wherein the receiver is configured to receive the combined signal, and convert the combined signal into an acoustic output signal, and wherein the receiver has a frequency response with lower a cut-off frequency that is less than 40 Hz.

In accordance with other embodiments, a hearing aid includes an ambient microphone configured to receive and convert environmental sound into an electronic input signal, a hearing loss processor configured to process the electronic input signal in accordance with a hearing loss of a user, and generate an electronic output signal, a receiver, an ear canal microphone configured for converting ear canal sound pressure into an ear canal signal, an occlusion suppressor for reception and processing of the ear canal signal and for transmitting an occlusion suppression signal, and a signal combiner configured for combining the occlusion suppression signal and the electronic output signal to form a combined signal, and for transmitting the combined signal to the receiver, wherein the receiver is configured to receive the combined signal, and convert the combined signal into an acoustic output signal, and wherein the receiver has a frequency response for suppression of occlusion signals.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope. The embodiments will be described in more detail in connection with the appended drawings, in which.

DESCRIPTION OF THE EMBODIMENTS

Figure 1A:
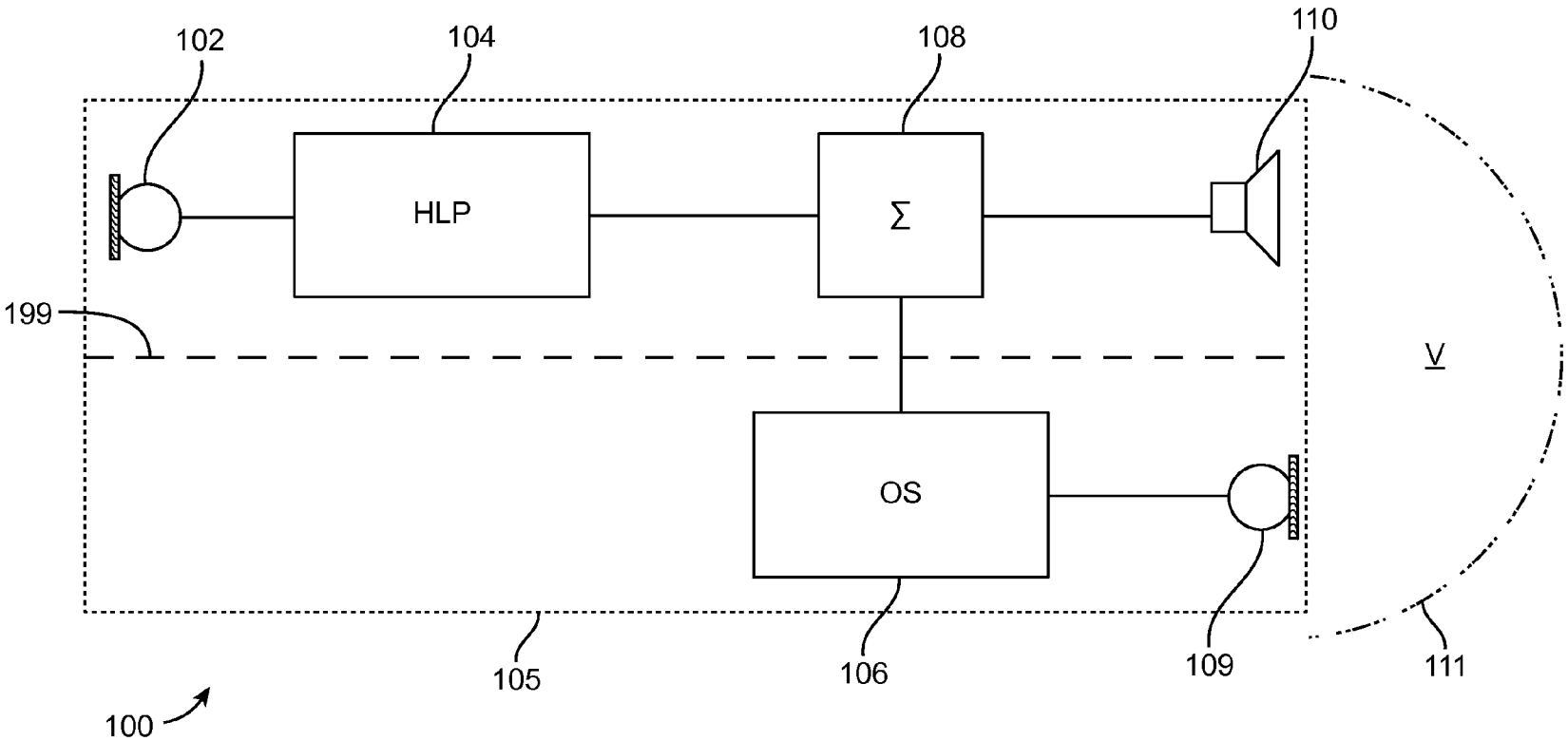
FIGS. 1A-1G show hearing aids with occlusion suppression in accordance with different embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The present application relates to a hearing aid which comprises an occlusion suppression system and a receiver with extended low frequency response to improve suppression of occlusion signals in a hearing aid user's ear canal.

One object of the embodiments described herein is to reduce a ratio of the occlusion sound pressure relative to amplified sound pressure in the hearing aid user's ear canal at very low frequencies, such as below 100 Hz or below 40 Hz, providing numerous advantages such as allowing significant vent size reduction and increasing a maximum stable gain of the hearing aid. Another advantage is improving the number of successful hearing aid fits for smaller ear canals, where available space for the vent can be more limited. Another object of the embodiments described herein is to eliminate or at least suppress the previously mentioned artefact sounds generated by feedback loop instability and/or output amplifier overload in connection with occlusion suppression.

Currently, the choice and design of receivers used for occlusion suppression hearing aids have been based on considerations related to hearing loss compensation. However, the present Applicant has by a combination of experiments and circuit simulations demonstrated that utilizing a receiver with an extended low frequency response in an active occlusion suppressing hearing aid leads to a considerable improvement in its ability to reduce occlusion. The present Applicant has determined that has there has been a failure to identify that occlusion effects extend beyond the frequency range normally considered for amplification in connection with hearing loss compensation such as amplification between 200 Hz and 10 kHz. Therefore existing hearing aid receivers in occlusion suppressing hearing aids have been unable to produce considerable sound pressure levels at low frequencies, in particular at subsonic frequencies below 20 Hz.

According to a first aspect, there is provided a hearing aid comprising an ambient microphone adapted to receive and convert environmental sound into an electronic input signal. A hearing loss processor is adapted to compensate the electronic input signal in accordance with a hearing loss of the user and generate an electronic output signal. A receiver is adapted to receive and convert a combined signal into an acoustic output signal and an ear canal microphone adapted to convert ear canal sound pressure into an ear canal signal. An occlusion suppressor is connected for reception and processing of the ear canal signal and for transmitting an occlusion suppression signal to a signal combiner combining the occlusion suppression signal and the electronic output signal. The combined signal is transmitted to the receiver. In accordance with some embodiments, a lower cut-off frequency of a frequency response of the receiver is less than 40 Hz, preferably less than 25 Hz, even more preferably less than 5 Hz.

In the present context, the lower cut-off frequency of the frequency response of the receiver is measured by coupling the receiver to an IEC 711 Ear Simulator or coupler via 10 mm of Ø 1 mm tubing. The lower cut-off frequency is a frequency, in a frequency range below 1 kHz, where the sound pressure level is 3 dB lower than a sound pressure level at 1 kHz. The receiver may comprise a miniature electro-dynamic or moving coil loudspeaker or a miniature balanced armature receiver such as a Knowles FH 3375 hearing aid receiver. A suitable receiver with extended low frequency response so as to comply with the above-referenced range of lower cut-off frequencies can be manufactured by reducing a size of a barometric pressure relief hole placed in a diaphragm of a standard balanced armature receiver. Alternatively, the barometric relief hole may be removed from the diaphragm and a hole, vent or acoustic channel of suitable dimensions placed in a rear chamber casing of the receiver.

Experimental tests and circuit simulations conducted by the inventor have revealed that a receiver with extended low frequency response as stated above is highly beneficial in improving suppression of occlusion sound pressure in hearing aids or instruments. The inventor has experimentally identified a number of occlusion sound pressure sources, such as jaw motions of the user, which create surprisingly large ear canal sound pressures within the fully or partly sealed ear canal at very low frequencies (including sound at subsonic frequencies below 20 Hz). In some hearing aids with active occlusion suppression, these large sound pressure levels at low frequencies have not been adequately suppressed or accompanied by sound artefacts such as popping or clicking. A feedback loop through the occlusion suppressor to the signal combiner generates high amplitude drive to the receiver in seeking to cancel the above-mentioned large low frequency sound pressure levels within the user's ear canal. The above-mentioned sound artefacts are created by overloading or saturating an output stage amplifier and/or the receiver itself. By using the above-specified receiver with extended low frequency response, preferably in combination with an appropriately sized acoustical vent, the present hearing aid is capable of generating large sound pressure levels at low frequencies without overloading the output stage amplifier and/or the receiver itself so as to provide effective cancellation of low frequency occlusion sound pressure levels without audible sound artefacts.

The present hearing aid may be embodied as an in-the-ear (ITE), in-the-canal (ITC), or completely-in-the-canal (CIC) aid with a housing or housing portion shaped and sized to fit the user's ear canal. The housing is preferably enclosing the ambient microphone, hearing loss processor, occlusion suppressor, ear canal microphone and the receiver inside a customized hard or soft shell of the housing. Alternatively, the present hearing aid may be embodied as a receiver-in-the-ear BTE or traditional behind-the-ear (BTE) aid comprising a vented or non-vented ear mould for insertion into the user's canal so to fully or partly block the ear canal. The BTE aid may comprise a flexible sound tube adapted for transmitting sound pressure generated by a receiver placed within a housing of the BTE aid to the user's ear canal. In this embodiment, the ear canal microphone may be arranged in the ear mould while the ambient microphone, hearing loss processor, occlusion suppressor and the receiver are located inside the BTE housing. The ear canal signal may be transmitted to the occlusion suppressor through a suitable electrical cable or another wired or unwired communication channel.

The ambient microphone may be positioned inside the hearing aid housing for example close to a faceplate of an ITE or CIC hearing aid housing. The microphone may alternatively be physically separate from the hearing aid housing and coupled to the hearing loss processor by a wired or wireless communication link.

The ear canal microphone preferably has a sound inlet positioned at a tip portion of the ITE, ITC or CIC hearing aid housing or tip of the ear mould of the BTE hearing aid allowing unhindered sensing of the ear canal sound pressure within the fully or partly occluded ear canal volume residing in front of the user's tympanic membrane or ear drum.

The signal combiner may comprise a subtraction circuit or subtraction function implemented in analog format or digitally to subtract the occlusion suppression signal from the electronic output signal to establish a feedback path around the receiver and an output amplifier of the hearing aid. The occlusion suppression signal is preferably derived from the feedback path of the occlusion suppressor so that both occlusion sound pressure, generated by body conduction, and low-frequency components representing the intended signal from the hearing loss processor of the acoustic output signal of the receiver are attenuated by approximately similar amounts.

The hearing loss processor may comprise a programmable low power microprocessor such as a programmable Digital Signal Processor executing a predetermined set of program instructions to amplify and process the electronic input signal in accordance with the hearing loss of the user and generate an appropriate electronic output signal. Alternatively, the hearing loss processor may comprise a processor based on hard-wired arithmetic and logic circuitry configured to perform a corresponding amplification and processing of the electronic input signal. In these embodiments, the electronic input signal is provided as digital signal provided by an A/D-converter that may be integrated with the hearing loss processor or arranged in a housing of the ambient microphone.

The occlusion suppressor may be implemented in various technologies or formats for example analog, digital or a combination thereof. In one fully digital embodiment, the occlusion suppressor comprises a predetermined set of program instructions executed on the above-mentioned programmable Digital Signal Processor of the hearing loss processor. In this embodiment, a single DSP may be utilized for implementing both the hearing loss processor and the occlusion suppressor leading to hardware savings. In another embodiment, the occlusion suppressor comprises a hard-wired arithmetic and logic circuit block configured to provide the processing of the ear canal signal and transmittal of the occlusion suppression signal to the signal combiner. The occlusion suppressor may be integrated with the hearing loss processor on a common semiconductor substrate or provided as a separate digital circuit.

The ear canal microphone preferably has a sound inlet positioned at a tip portion of the hearing aid housing or tip of the ear mould allowing essentially unobstructed sensing of sound pressure inside an ear canal volume residing in front of the user's tympanic membrane or ear drum.

According to some embodiments, the receiver comprises a diaphragm hole and/or a rear chamber vent setting the lower cut-off frequency of the frequency response of the receiver. In some embodiments, the diaphragm lacks the diaphragm hole or barometric pressure relief hole and the lower cut-off frequency is mainly determined by dimensions, such as length and width, of the rear chamber vent. A significant advantage of the latter embodiment is that it allows boosting of the frequency response of the receiver at low frequencies below a predetermined frequency determined by dimensions of the rear chamber vent and dimensions of the rear chamber. The boosting of the frequency response below the predetermined frequency increases low frequency output capability and provides a more favourable phase response in vicinity of the predetermined frequency.

In other embodiments, the receiver lacks the rear chamber vent and the lower cut-off frequency is instead mainly determined by dimensions of the diaphragm hole that may have smaller dimensions than a diaphragm hole in standard receiver.

According to some embodiments, an acoustical vent is extending through or around the housing or the ear mould of the hearing aid. The acoustical vent may have a high pass cut-off frequency between 100 Hz and 500 Hz or more preferably between 200 Hz and 300 Hz. The acoustical vent may comprise one or more acoustical channels or conduits establishing an acoustical connection between the ear canal volume residing in front of the user's ear drum and the surrounding environment. The acoustical vent allows low frequency sound to propagate from the ear canal volume to the surrounding environment and vice versa. The acoustical vent will therefore contribute as a high pass filter to a frequency response of the hearing aid. The high pass cut-off frequency of this high pass filter will depend on a shape and size of the acoustical vent. In the present specification, the term "acoustical vent" covers both a specific physical channel, or channels, and an open or loose fit between user's ear canal and the hearing aid housing or ear mould creating an acoustical leakage path.

While optimum frequency response characteristics of an acoustic feedback loop which comprises the acoustical vent may be distributed in various ways amongst individual components and functions such as the ear canal microphone, the receiver, the occlusion suppressor, the combined signal etc there are significant advantages to setting the high pass cut-off frequency of the acoustical vent as a dominant low frequency cut-off of the acoustic feedback loop. The high pass cut-off frequency of the acoustical vent is often the only function which passively reduces amplitude of subsonic jaw motion related or generated components of the ear canal sound pressure. The high pass cut-off frequency of the acoustical vent may ideally reduce the subsonic jaw motion generated components of the ear canal sound pressure to a level which does not need to be cancelled by the occlusion suppression system.

This relieves the occlusion suppression system of the burden of processing or handling very high subsonic sound pressure imposed on the ear canal microphone and reduces the subsonic portion of the combined signal applied to the receiver to an acceptable level. Consequently, the very high subsonic sound pressure is prevented from impairing dynamic range of the occlusion suppression system for speech frequency occlusion cancellation. Furthermore, battery power or energy of a hearing aid battery is preserved by the suppression of the subsonic portion of the combined signal applied to the receiver. A knowledge of acoustical vent characteristics as relates to vent damping and transition from second to first order frequency response (zero location) may be used to improve the behaviour of the acoustic feedback loop which comprises the acoustical vent and reduce any peaking of the frequency response of the hearing aid in a low frequency region below speech frequencies such as below 100 Hz.

In one embodiment where the high pass cut-off frequency of the acoustical vent is the dominant low frequency cut-off, a difference between the lower cut-off frequency of the receiver and the high pass cut-off frequency of the acoustical vent or vent is larger than one octave or larger than 2 octaves wherein the high pass cut-off frequency of the vent is the higher cut-off frequency. In a certain variants of the latter embodiment, the high pass cut-off frequency of the vent lies between 150 Hz and 300 Hz while the lower cut-off frequency of the frequency response of the receiver lies below 50 Hz or more preferably below 40 Hz, or even more preferably below 10 Hz such as below 5 Hz.

According to yet another embodiment, high pass characteristics of a frequency response of the acoustical vent comprises a transition frequency situated in a frequency range below the high pass cut-off frequency of the acoustical vent. The transition frequency is separating a first order frequency response roll-off at frequencies below the transition frequency and second order frequency response roll-off at frequencies above the transition frequency. The transition frequency is situated in vicinity of a lower cut-off frequency of a frequency response of the canal microphone such as between 1 octave below and 1 octave above the lower cut-off frequency of the frequency response of the ear canal microphone. This embodiment is useful in minimizing phase shift in the frequency region below the high pass cut-off frequency of the acoustical vent so as to minimize peaking of the closed loop frequency response of the hearing aid in that frequency region.

According to another advantageous embodiment, a sound inlet of the ear canal microphone is positioned outside the near-field region of a sound outlet or port of the receiver. A too short distance between the sound outlet of the receiver and the sound inlet of the microphone inside the ear canal volume may lead to frequency response aberrations which are very complex to predict and compensate. The near field region of the receiver may for this purpose be defined using an axis centrally in the user's ear canal, and projecting respective positions of the receiver and the microphone on this central axis. If the distance between the sound inlet of the ear canal microphone and the sound outlet of the receiver along the central axis is larger than 2 mm, the microphone sound inlet is considered to be outside the near-field region of the receiver.

In an embodiment, the occlusion suppressor comprises a feedback path receiving and filtering the ear canal signal with a predetermined feedback transfer function to produce the occlusion suppression signal. By adjusting or tailoring the transfer function of the feedback path to certain features of the frequency response of the hearing aid, the provision of undesirable gain at one or more frequencies in the feedback transfer function may be avoided. This is useful for suppressing pronounced peaks in the frequency response of the hearing aid such as frequency response peaks caused by high frequency resonances of the receiver and/or other acoustical components of the hearing aid at or above 1 kHz such as between a frequency range between 1 kHz and 12 kHz. Therefore, undesired amplification of microphone noise within the 1-12 kHz frequency range, in which a considerable portion is very important for the understanding of speech, can be avoided.

In a preferred embodiment, the predetermined feedback transfer function comprises a frequency selective filter having predetermined transfer function characteristics. The predetermined transfer function characteristics of the frequency selective filter may be configured to compensate for a frequency response peak of a frequency response of the hearing aid. In one such embodiment, the frequency selective filter may comprise a notch filter having a predetermined centre frequency and a predetermined bandwidth. The predetermined centre frequency and bandwidth of the notch filter may advantageously by tailored to compensate for the above-mentioned frequency response peaks caused by high frequency resonances of the receiver and/or acoustical system in the 1-12 kHz frequency response range. The compensation is preferably made by setting the predetermined centre frequency of the notch filter substantially equal to a peak frequency of the frequency response peak. Optionally, the predetermined bandwidth of the notch filter may be set essentially equal to a bandwidth of the frequency response peak in question. Naturally, the predetermined feedback transfer function may comprise a plurality of frequency selective filters of the same type or of different types such as any combination of highpass filters, lowpass filters, bandpass filters, shelf filters and notch filters. In one embodiment, the predetermined feedback transfer function comprises 2, 3 or even more separate notch filters, having respective predetermined centre frequencies and bandwidths arranged to compensate for respective ones of a plurality of different frequency response peaks of the frequency response of the hearing aid.

In an embodiment, the occlusion processor is adapted to receive and store filter parameters associated with the predetermined transfer function characteristics of the frequency selective filter or respective filter parameters associated with the transfer function characteristics of a plurality of frequency selective filters. According to one embodiment, wherein the occlusion suppressor comprises the above-mentioned hard-wired or programmable Digital Signal Processor, the filter parameters may be stored as binary coefficients or numbers in a predetermined address range of a non-volatile memory accessible to the Digital Signal Processor. The occlusion processor may be adapted to receive and store the filter parameters associated with the predetermined transfer function characteristics of the frequency selective filter during a fitting procedure of the hearing aid. During the fitting procedure, the occlusion suppressor may be directly or indirectly coupled to a fitting computer through a wired or wireless communication channel. The occlusion processor may comprise, or be connected to, a data interface complying with a data transmission protocol of the wired or wireless communication channel allowing the occlusion processor to receive the filter parameters. The occlusion processor or the hearing loss processor is preferably configured to write these filter parameters to a predetermined address space or range of the non-volatile memory. Alternatively, the fitting computer may be adapted to directly connect to, access, and write the filter parameters to the predetermined address space or range in the non-volatile memory for subsequent read out by the occlusion processor or the hearing loss processor. Appropriate filter parameters may be determined by the fitting system or computer through an open-loop and/or closed loop measurement of the transfer function of the hearing aid when mounted in the user's ear. This transfer function is generally complex and involves contributions from the electrical and acoustical couplings between ambient microphone, hearing loss processor, occlusion suppressor, output amplifier, receiver, vent, ear canal and the user's tympanic membrane. An acoustical analysis of this transfer function will typically show a multitude of resonance frequencies, and their spectral positions will define acoustical system stability and the system performance.

The experimental hearing aid 100 depicted on FIG. 1A comprises a hearing aid housing 105 which may comprise a custom made hard acrylic shell sized and shaped to fir a user's ear canal. An ambient microphone 102 may be situated in a proximate portion of the hearing aid housing 105 with a sound inlet (not shown) arranged in an outwardly oriented face or faceplate of the housing 105. The sound inlet conveys sound pressure or sound from the environment surrounding the user to the ambient microphone 102 so as to generate an electronic input or microphone signal representative of received sound. The electronic microphone signal is transmitted to a hearing loss processor 104 operatively coupled to the ambient microphone 102. In the present embodiment, the hearing loss processor 104 comprises a programmable low power Digital Signal Processor (DSP). The electronic microphone signal is provided in digital format for example by an oversampled A/D converter positioned inside a housing of the ambient microphone 102. The hearing loss processor 104 is adapted to compensate the electronic input signal in accordance with a determined hearing loss of the user and generate a corresponding electronic output signal which is supplied to a signal combiner 108. In the present embodiment, the signal combiner 108 is embodied as a signal subtractor adapted for subtracting the electronic output signal and an occlusion suppression signal supplied by the occlusion suppressor 106. The occlusion suppression signal is derived from an ear canal signal generated by an ear canal microphone 109 in response to detected ear canal sound pressure within a fully or partly occluded ear canal volume, V, 111 in front of the user's tympanic membrane. The ear canal microphone 109 is preferably arranged in a distal portion of the hearing aid housing 105 and with a sound inlet extending through a tip portion of the hearing aid housing 105 to sense the ear canal sound pressure inside the ear canal volume 111. As previously explained, during normal use of the hearing aid 100, the ear canal sound pressure detected by the ear canal microphone 109 will be a superposition of body conducted sound and receiver emitted/generated sound.

A receiver 110, such as a miniature balanced armature receiver, is adapted to receive and convert a combined signal supplied at an output of the subtractor 108 into an acoustic output signal. The receiver 110 preferably has an extended low frequency response to improve suppression of occlusion sound pressures within the fully or partly occluded ear canal volume 111. In the present embodiment, a lower cut-off frequency of a frequency response of the receiver is set to about 2 Hz or lower. However, in other embodiments, the lower cut-off frequency may be set to a value less than 40 Hz, or more preferably less than 25 Hz such as less than 5 Hz.

As shown in FIG. 1A, the experimental hearing aid also optionally includes a vent 199 extending through a hearing aid housing.

Figure 1B:
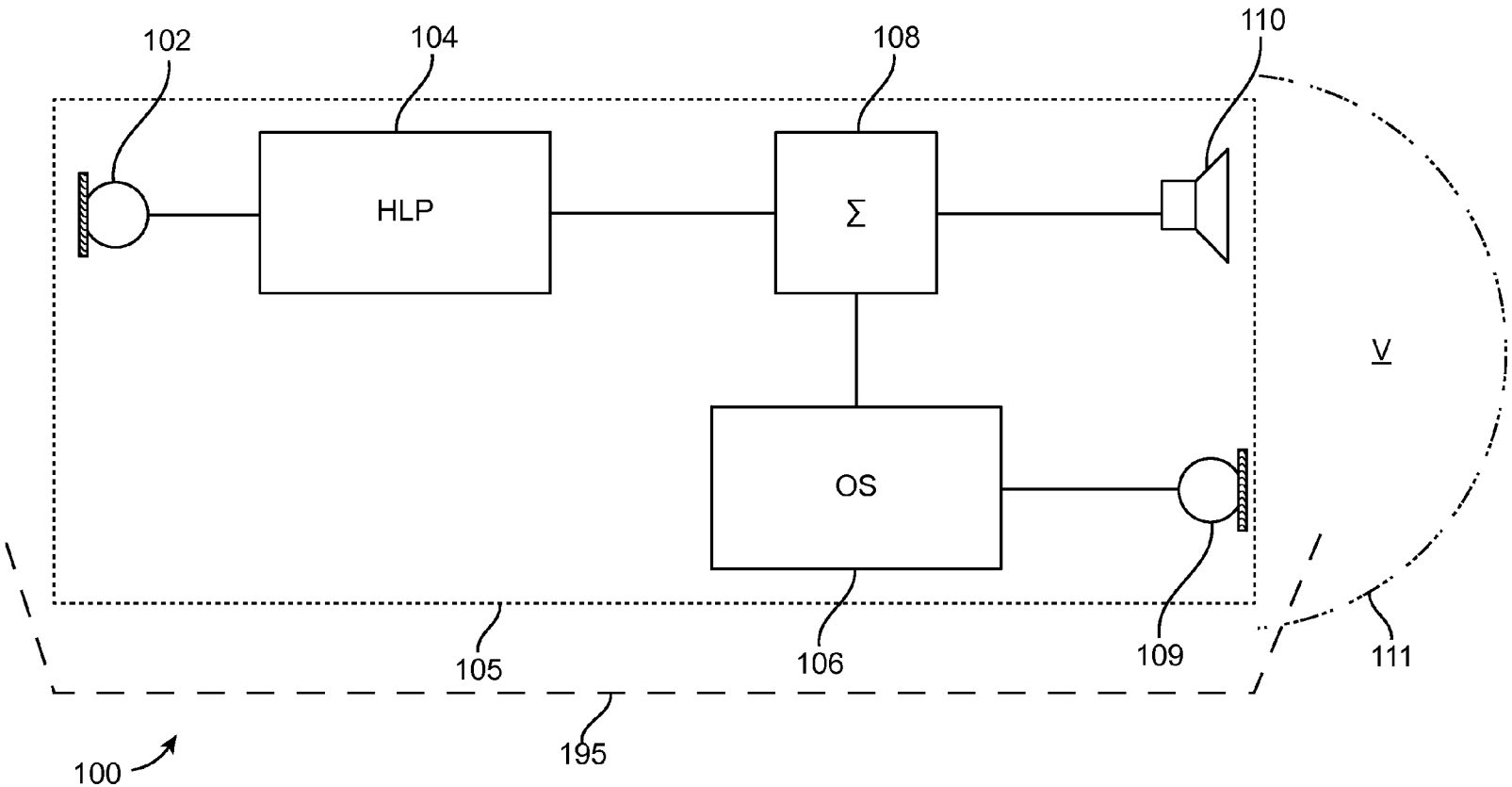

In other embodiments, the experimental hearing aid may have a vent 195 extending around a hearing aid housing (FIG. 1B).

Figure 1C:
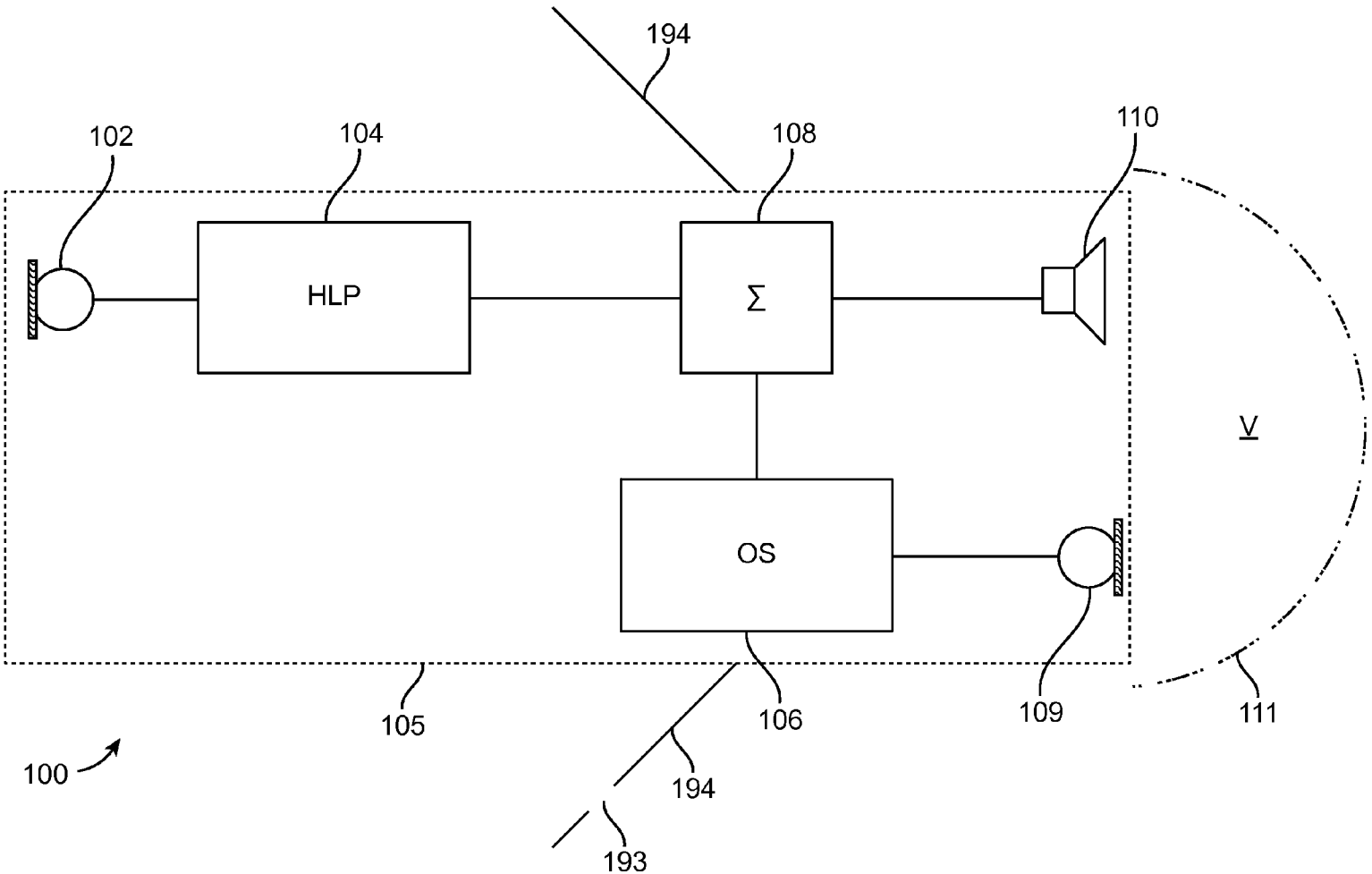

In other embodiments, the experimental hearing aid may have an ear piece 194 extending from a hearing aid housing, wherein a vent 193 extends through the ear piece 194 (FIG. 1C).

Figure 1D:
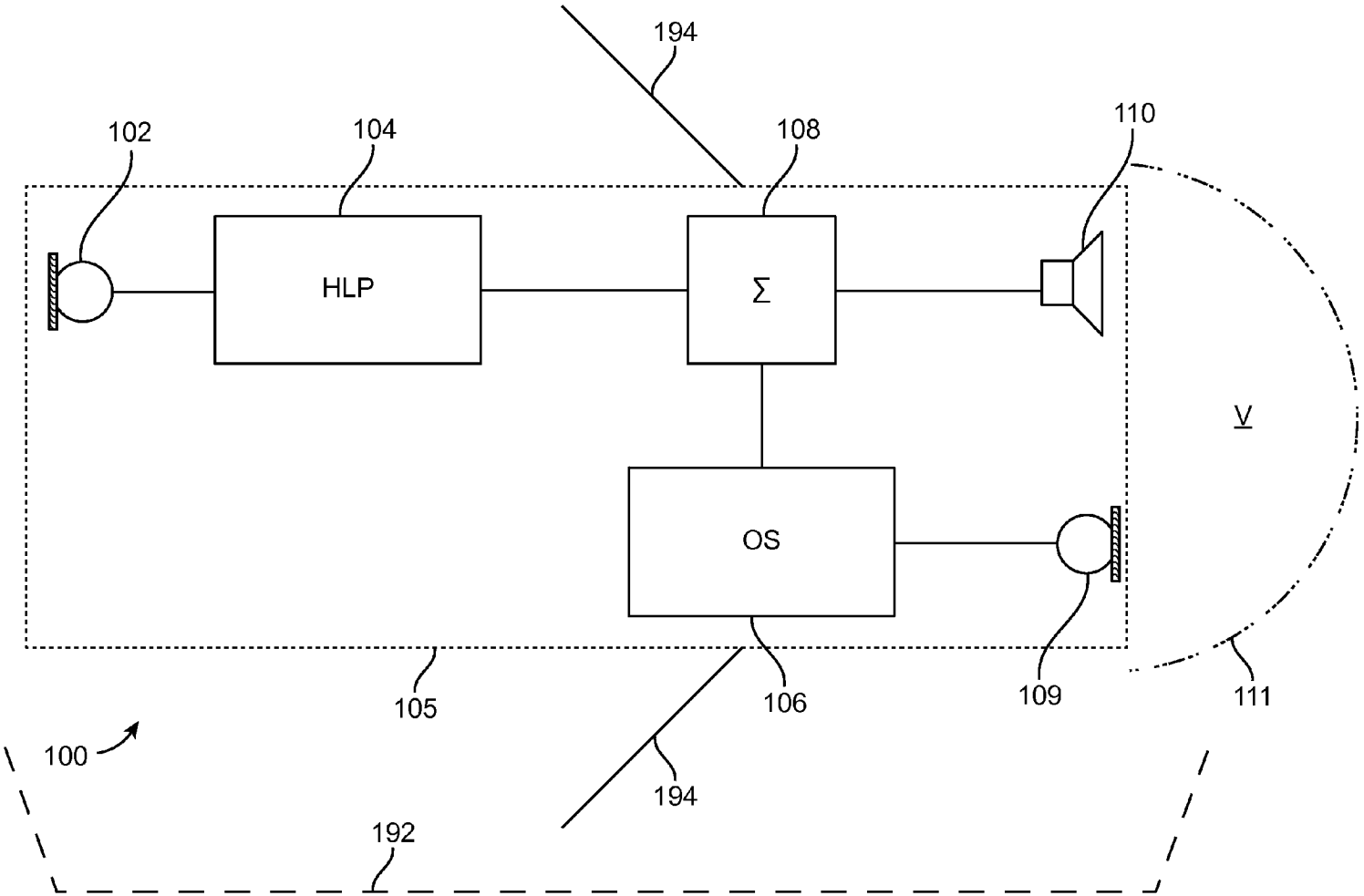

In other embodiments, the experimental hearing aid may have an ear piece 194 extending from a hearing aid housing, wherein a vent 192 extends around the ear piece 194 (FIG. 1D).

Figure 1E:
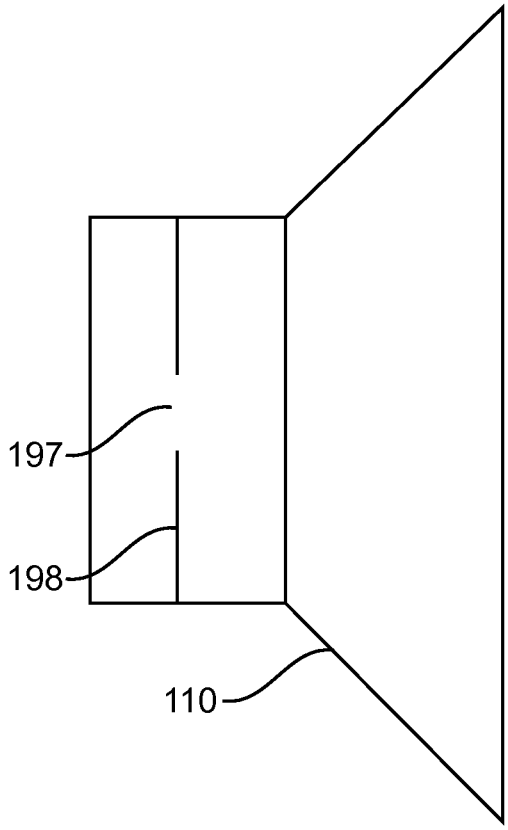

In other embodiments, the receiver 110 of FIGS. 1A-1D may include a diaphragm 198 and a diaphragm hole 197 (FIG. 1E).

Figure 1F:
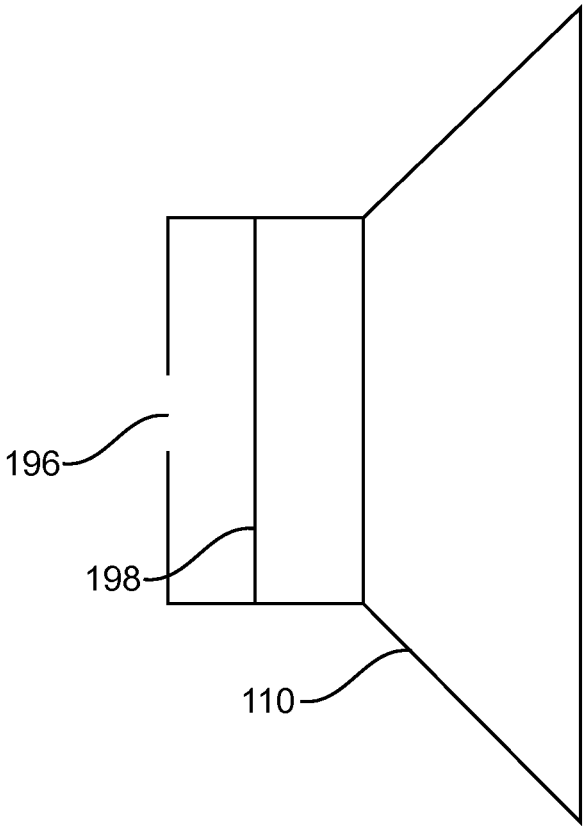

In other embodiments, the receiver 110 of FIGS. 1A-1D may have a diaphragm 198 and a rear chamber vent 196 (FIG. 1F).

Figure 1G:
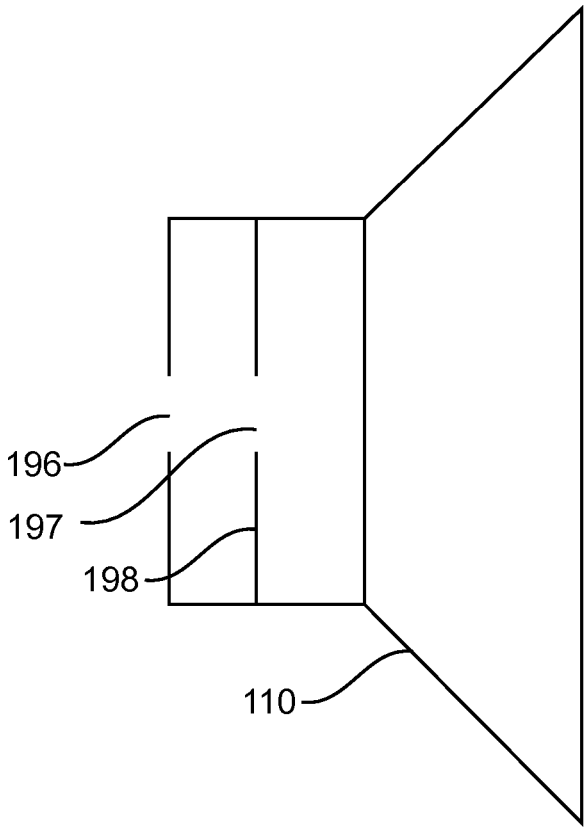

In other embodiments, the receiver 110 of FIGS. 1A-1D may have a diaphragm 198, a diaphragm hole 197 and a rear chamber vent 196 (FIG. 1G).

Figure 2:
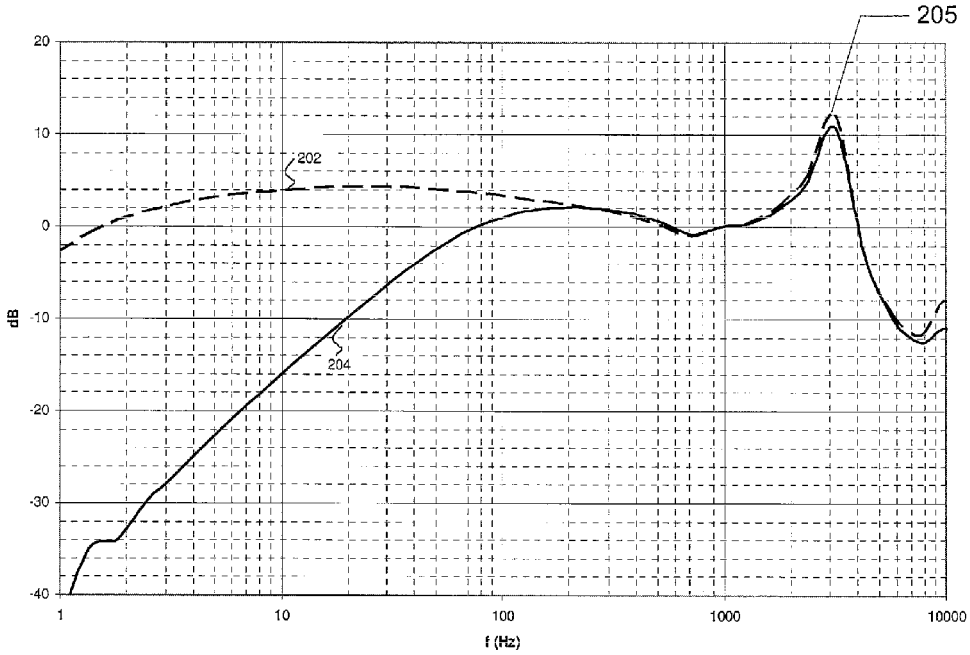
FIG. 2 depicts frequency response measurements on a standard receiver and a receiver with extended low frequency response used in the experimental hearing aid depicted on FIG. 1.

FIG. 2 depicts frequency response measurements on two different receivers used in the experimental hearing aid depicted on FIG. 1. The frequency response curve 204 was obtained from a standard receiver having a lower cut-off frequency of about 50 Hz as evident by comparing the recorded 1 kHz sound pressure level to the sound pressure level at 50 Hz. The frequency response curve 202 was on the other hand measured on a specially modified balanced armature receiver with a lower cut-off frequency of about 1 Hz as illustrated.

The experimental hearing aid 100, corresponding to the simplified schematic diagram of FIG. 1, was evaluated experimentally on an acoustical coupler in three different configurations:

1) In a first exemplary configuration with a receiver with a normal lower cut-off frequency as illustrated on frequency response curve 204 of FIG. 2.

2) In a second exemplary configuration with a receiver with a normal lower cut-off frequency as illustrated on frequency response curve 202 of FIG. 2 and with a notch filter inserted in a feedback path of the occlusion suppressor 106.

3) In a third configuration with a receiver with the extended low frequency response and with the notch filter inserted in the feedback path of the occlusion suppressor 106.

In configurations 2) and 3) above, the feedback path is operative to receiving and filtering the ear canal signal supplied by the ear canal microphone with a feedback transfer function at least partly determined by the notch filter. The notch filter has a predetermined centre frequency and a predetermined bandwidth set or configured to compensate for a pronounced frequency response peak 205 of the frequency response of the hearing aid. In the present case, this frequency response peak 205 is largely determined by a mechanical/acoustical resonance of the receiver (110 of FIG. 1) at about 3 kHz but in other embodiments, frequency response peaks may be caused by various acoustical, mechanical or electrical circuits of an electrical or acoustical signal transmission path of the hearing aid.

Figure 3:
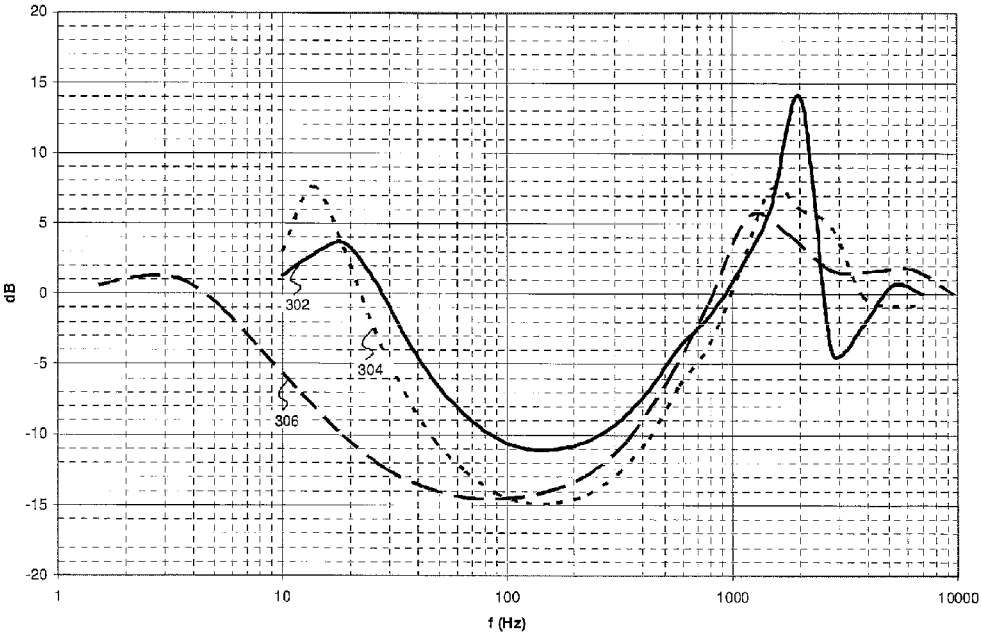
FIG. 3 shows measured occlusion suppression values versus frequency for the experimental hearing aid depicted on FIG. 1 with the two different receivers tested on FIG. 2.

The results of the evaluation are summarized in FIG. 3 which shows measured occlusion suppression in dB versus frequency for each of the three different configurations outlined above. The 0 dB line indicates no change of the measured level of the occlusion sound pressure within the user's ear canal by the action of the occlusion suppression system. A positive or negative reading reflects a higher or lower occlusion sound pressure, respectively.

The hearing aid with the standard receiver corresponding to configuration 1) above obtains approximately 9-11 dB of cancellation in a frequency range between 100 Hz and 300 Hz as indicated by curve 302. However, an undesired lack of occlusion suppression takes place at lower and higher frequencies such as below 25 Hz and above 1 kHz, in particular in vicinity of the response peak 205, where the occlusion sound pressure increases to a level higher than the unassisted case.

The hearing aid with the standard receiver and the notch filter in the feedback path, corresponding to configuration 2) above, obtains approximately 13-15 dB of cancellation in a frequency range between 100 Hz and 300 Hz as indicated by the dotted curve 304. Furthermore, occlusion suppression in vicinity of the response peak 205 has been significantly improved by about 6-8 dB. However, an undesired lack of occlusion suppression remains at lower frequencies such as below 25 Hz as illustrated by dotted curve 304.

The hearing aid configuration with the receiver with extended low frequency response, i.e. corresponding to configuration 3) above, obtains much improved occlusion suppression or attenuation in the entire low-frequency response range of the present experimental hearing aid. A dramatic improvement in occlusion suppression of about 8-15 dB in a frequency range between 10 Hz and 25 Hz and 3 dB up to 50 Hz is readily observable compared to configuration 2) above.

The invention claimed is:

1. A hearing aid comprising:

an ambient microphone configured to receive and convert environmental sound into an electronic input signal;

a hearing loss processor configured to process the electronic input signal in accordance with a hearing loss of a user, and generate an electronic output signal;

a receiver;

an ear canal microphone configured for converting ear canal sound pressure into an ear canal signal;

an occlusion suppressor for reception and processing of the ear canal signal and for transmitting an occlusion suppression signal;

a signal combiner configured for combining the occlusion suppression signal and the electronic output signal to form a combined signal, and for transmitting the combined signal to the receiver;

a housing for housing the processor;

an ear piece coupled to the housing; and an acoustical vent extending through or around the housing or the ear piece, wherein the acoustical vent has a high pass cut-off frequency;

wherein the receiver is configured to receive the combined signal, and convert the combined signal into an acoustic output signal; and wherein the receiver has a frequency response with a lower cut-off frequency;

wherein a difference between the lower cut-off frequency of the frequency response of the receiver and the high pass cut-off frequency of the acoustical vent is larger than one octave such that the high pass cut-off frequency of the acoustical vent is a higher cut-off frequency.

2. The hearing aid according to claim 1, wherein the receiver comprises one or both of a diaphragm hole and a rear chamber vent for providing the cut-off frequency of the frequency response of the receiver.

3. The hearing aid according to claim 1, wherein the high pass cut-off frequency is between 200 Hz and 300 Hz.

4. The hearing aid according to claim 1, wherein the ear canal microphone has a sound inlet that is positioned outside a near-field region of a sound outlet of the receiver.

5. The hearing aid according to claim 1, wherein the occlusion suppressor comprises a feedback path receiving and filtering the ear canal signal with a predetermined feedback transfer function to produce the occlusion suppression signal.

6. The hearing aid of claim 1, wherein the lower cut-off frequency is less than 25 Hz.

7. The hearing aid of claim 1, wherein the lower cut-off frequency is less than 5 Hz.

8. The hearing aid according to claim 1, wherein the lower cut-off frequency is less than 40 Hz.

9. The hearing aid according to claim 1, wherein the high pass cut-off frequency is between 100 Hz and 500 Hz.

10. A hearing aid comprising:

an ambient microphone configured to receive and convert environmental sound into an electronic input signal;

a hearing loss processor configured to process the electronic input signal in accordance with a hearing loss of a user, and generate an electronic output signal;

a receiver:

an ear canal microphone configured for converting ear canal sound pressure into an ear canal signal;

an occlusion suppressor for reception and processing of the ear canal signal and for transmitting an occlusion suppression signal;

a signal combiner configured for combining the occlusion suppression signal and the electronic output signal to form a combined signal, and for transmitting the combined signal to the receiver;

a housing for housing the processor;

an ear piece coupled to the housing; and an acoustical vent extending through or around the housing or the ear piece, wherein the acoustical vent has a high pass cut-off frequency;

wherein the receiver is configured to receive the combined signal, and convert the combined signal into an acoustic output signal;

wherein the receiver has a frequency response with a lower cut-off frequency; and wherein high pass characteristics of a frequency response of the acoustical vent comprises a transition frequency situated in a frequency range below the high pass cut-off frequency of the acoustical vent.

11. The hearing aid according to claim 10, wherein the transition frequency separates a first order frequency response roll-off at frequencies below the transition frequency and a second order frequency response roll-off at frequencies above the transition frequency.

12. The hearing aid according to claim 10, wherein the transition frequency is situated in a vicinity of a lower cut-off frequency of a frequency response of the ear canal microphone.

13. The hearing aid according to claim 12, wherein the transition frequency is situated between 1 octave below and 1 octave above the lower cut-off frequency of the frequency response of the ear canal microphone.

14. A hearing aid comprising:

an ambient microphone configured to receive and convert environmental sound into an electronic input signal;

a hearing loss processor configured to process the electronic input signal in accordance with a hearing loss of a user, and generate an electronic output signal;

a receiver;

an ear canal microphone configured for converting ear canal sound pressure into an ear canal signal;

an occlusion suppressor for reception and processing of the ear canal signal and for transmitting an occlusion suppression signal; and a signal combiner configured for combining the occlusion suppression signal and the electronic output signal to form a combined signal, and for transmitting the combined signal to the receiver;

wherein the receiver is configured to receive the combined signal, and convert the combined signal into an acoustic output signal;

wherein the receiver has a frequency response with a lower cut-off frequency;

wherein the occlusion suppressor comprises a feedback path receiving and filtering the ear canal signal with a predetermined feedback transfer function to produce the occlusion suppression signal; and wherein the predetermined feedback transfer function comprises a frequency selective filter having predetermined transfer function characteristics.

15. The hearing aid according to claim 14, wherein the frequency selective filter comprises a notch filter having a predetermined center frequency and a predetermined bandwidth.

16. The hearing aid according to claim 14, wherein the occlusion suppressor is configured to receive and store filter parameters associated with the predetermined transfer function characteristics of the frequency selective filter.

17. The hearing aid according to claim 16, wherein the occlusion suppressor is configured to receive and store the filter parameters associated with the predetermined transfer function characteristics of the frequency selective filter during a fitting procedure.

18. The hearing aid according to claim 14, wherein the predetermined transfer function characteristics of the frequency selective filter is configured to compensate for a frequency response peak of a frequency response of the hearing aid.

19. The hearing aid of claim 14, wherein the lower cut-off frequency that is less than 40 Hz.

20. The hearing aid of claim 14, wherein the lower cut-off frequency that is less than 25 Hz.

21. The hearing aid of claim 14, wherein the lower cut-off frequency that is less than 5 Hz.

* * * * *